US007520906B2

(12) United States Patent
Gormley

(10) Patent No.: US 7,520,906 B2
(45) Date of Patent: Apr. 21, 2009

(54) FUEL OIL COMPOSITION

(75) Inventor: Fiona K. Gormley, Malahide (IE)

(73) Assignee: Infineum International Ltd., Oxfordshire (GB)

( * ) Notice: Subject to any disclaimer, the term of this patent is extended or adjusted under 35 U.S.C. 154(b) by 582 days.

(21) Appl. No.: 10/882,120

(22) Filed: Jun. 30, 2004

(65) Prior Publication Data

US 2005/0039384 A1 Feb. 24, 2005

(30) Foreign Application Priority Data

Jul. 3, 2003 (EP) ..... 03254230

(51) Int. Cl.
*C10L 1/18* (2006.01)

(52) U.S. Cl. ..... 44/397; 44/386; 44/393; 44/394; 44/403; 44/412

(58) Field of Classification Search ..... 44/386, 44/393, 394, 397, 403, 412
See application file for complete search history.

(56) References Cited

U.S. PATENT DOCUMENTS

| | | | | |
|---|---|---|---|---|
| 3,126,260 | A | 3/1964 | Van der Minne et al. | 44/62 |
| 4,356,002 | A | 10/1982 | Knepper et al. | 44/62 |
| 5,071,445 | A | 12/1991 | Oppenlaender et al. | 44/408 |
| 6,391,070 | B2 * | 5/2002 | Schield | 44/351 |
| 2004/0107635 | A1 * | 6/2004 | Henry, Jr. | 44/370 |

FOREIGN PATENT DOCUMENTS

| | | | |
|---|---|---|---|
| EP | 0 521 628 | B1 | 3/1996 |

* cited by examiner

*Primary Examiner*—Cephia D Toomer

(57) ABSTRACT

A fuel oil containing a conductivity improving additive comprising the combination of: (a) a polymethacrylate, polyacrylate or polyfumarate polymer not prepared from a quaternary ammonium monomer and having a number average molecular weight of about 1,000 to 10,000,000 and either (b) a conductivity improver comprising (i) an olefin polysulfone and (ii) a polymeric polyamine reaction product of epichlorohydrin and an aliphatic primary monoamine or an N-aliphatic hydrocarbyl alkylene diamine, or the sulfonic acid salt of the polymeric polyamine reaction product or (c) a conductivity improver comprising a hydrocarbon soluble copolymer of an alkylvinyl monomer and a cationic vinyl monomer, wherein the copolymer has an alkylvinyl monomer unit to cationic vinyl monomer unit ratio of from about 1:1 to about 10:1, the copolymer having a number average molecular weight of from about 800 to about 1,000,000.

9 Claims, No Drawings

FUEL OIL COMPOSITION

This invention relates to fuel oils which exhibit improved conductivity properties and an additive system for providing such properties The use of acrylate and methacrylate polymers in fuel oils is disclosed, for example, in U.S. Pat. No. 4,985,160 issued Jan. 15, 1991 to Henry et al. and U.S. Pat. No. 5,035,719 issued Jul. 30, 1991 to Sung et al., both of which disclose the use of such polymers for storage stability and U.S. Pat. No. 4,153,424 issued May 8, 1979 to Wisotsky, which discloses the use of such polymers in fuels as cold flow additives. U.S. Pat. No. 5,621,154 issued Apr. 15, 1997 to Wright et al. discloses the use of an ester of polyalkenylthiophosphonic acid as an additive for jet fuels in order to inhibit deposit formation.

U.S. Pat. No. 6,391,070, issued May 21, 2002 to Schield discloses a composition having increased electrical conductivity, which includes a) a liquid hydrocarbon; b) an anti-static amount of at least one hydrocarbon soluble copolymer of an alkylvinyl monomer and a cationic vinyl monomer, wherein the copolymer has an alkylvinyl monomer unit to cationic vinyl monomer unit ratio of from about 1:1 to about 10:1, the copolymer having an average molecular weight of from about 800 to about 1,000,000; and c) an anti-static amount of at least one hydrocarbon soluble polysulfone copolymer of at least one olefin and sulfur dioxide. These polymers are described by Schield in U.S. Pat. No. 5,672,183 as containing a cationic quaternary ammonium monomer.

The present invention is based upon the discovery that the use in combination of an acrylate, methacrylate or fumarate polymer, not prepared from a cationic quaternary ammonium monomer, with certain commercial conductivity improvers results in a synergistic effect upon the conductivity properties of a fuel oil having little or no inherent conductivity.

The invention is particularly useful for the formulation of turbine combustion fuel oils which are generally those hydrocarbon fuels having boiling ranges within the limits of about 150° to 600° F. and are designated by such terms as JP-4, JP-5, JP-7, JP-8, Jet A, Jet A-1. JP-4 and JP-5 are fuels defined by U.S. military specification MIL-T-5624-N and JP-8 is defined by U.S. Military Specification MIL-T83133-D. Jet A, Jet A-1 and Jet B are defined by ASTM specification D1655.

In accordance with the present invention there is provided a fuel oil composition which comprises a fuel oil having an inherent conductivity of less than 10 pS/m containing a two component additive comprising:

(a) a polymer of an ester of acrylic, methacrylic or fumaric acid, the polymer having a number average molecular weight of about 1,000 to 10,000,000, the polymer not being prepared from a cationic quaternary ammonium monomer; and either (b) a conductivity improver comprising (i) an olefin polysulfone and (ii) a polymeric polyamine reaction product of epichlorohydrin and an aliphatic primary monoamine or an N-aliphatic hydrocarbyl alkylene diamine, or the sulfonic acid salt of the polymeric polyamine reaction product. The weight ratio of the olefin polysulfone to the polymeric polyamine will preferably be in the range of 40:1 to 1:40, or (c) a conductivity improver comprising a hydrocarbon soluble copolymer of an alkylvinyl monomer and a cationic vinyl monomer, wherein the copolymer has an alkylvinyl monomer unit to cationic vinyl monomer unit ratio of from about 1:1 to about 10:1, the copolymer having a number average molecular weight of from about 800 to about 1,000,000.

Suitable polyacrylate, polymethacrylate or polyfumarate polymers are those polymers of ethylenically unsaturated monomers such as methacrylic, acrylic or fumaric acid esters of alcohols having about 1 to 40 carbon atoms, such as methylacrylate, ethylacrylate, n-propylacrylate, lauryl acrylate, stearyl acrylate, methylmethacrylate, ethylmethacrylate, n-propylmethacrylate, lauryl methacrylate, stearyl methacrylate and the like. These polymers may have number average molecular weights (Mn) of 1,000 to 10,000,000 and preferably the molecular weight range is from about 10,000 to 1,000,000, most preferably 10,000 to 100,000. These polymers do not include copolymers with quaternary ammonium acrylate monomers such as disclosed in U.S. Pat. No. 5,672,183.

In a preferred embodiment, the acrylate, methacrylate or fumarate monomer is copolymerized with an amine-containing or amide-containing monomer (excluding quaternary ammonium monomers), or the acrylate or methacrylate main chain polymer is provided so as to contain sites suitable for grafting, and then amine-containing or amide-containing branches, either monomers or macromonomers, (but excluding quaternary ammonium monomers or macromonomers), are grafted onto the main chain. Transesterification reactions or amidation reactions may also be employed to produce the same products. Preferably, the polymer will contain 0.4 to 4.0 wt. % nitrogen.

Examples of amine-containing monomers include: the basic amino substituted olefins such as p-(2-diethylaminoethyl) styrene; basic nitrogen-containing heterocycles having a polymerizable ethylenically unsaturated substituent, such as the vinyl pyridines or the vinyl pyrrolidones; esters of amino alcohols with unsaturated carboxylic acids such as dimethylaminoethyl methacrylate or dimethylaminopropyl methacrylate; amides of diamines with unsaturated carboxylic acids, such as dimethylaminopropyl methacrylamide; amides of polyamines with unsaturated carboxylic acids, examples of such polyamines being ethylene diamine (EDA), diethylene triamine (DETA), triethylene tetramine (TETA), tetraethylene pentamine (TEPA), pentaethylene hexamine (PEHA), and higher polyamines, PAM (N=7,8) and Heavy Polyamine (N>8); morpholine derivatives of unsaturated carboxylic acids, such as N-(aminopropyl)morpholine derivatives; and polymerizable unsaturated basic amines such as allyl amine.

Particularly preferred is a polymer of methacrylate of $C_8$-$C_{14}$ alcohols copolymerized with a methacrylamide of an (N,N-dialkylamino)alkylamine, such as dimethylaminopropylamine.

The weight average molecular weight of the polysulfone will be in the range of 10,000 to 1,500,000 with the preferred range being 50,000 to 900,000 and the most preferred molecular weight range being in the range of about 100,000 to 500,000. The olefins useful for the preparation of the polysulfones may have about 6 to 20 carbon atoms, preferably about 6 to 18 carbon atoms, with 1-decene polysulfone being particularly preferred. The preparation of these materials is known in the art as described for example in U.S. Pat. No. 3,917,466. The polymeric polyamine component is prepared by heating an amine with epichlorohydrin in the molar proportions of 1:1 to 1:1.5 in the range of 50° C. to 100° C. Suitable aliphatic primary amines will have about 8 to 24 carbon atoms, preferably about 8 to 12 carbon atoms, with the aliphatic group being preferably an alkyl group. If the amine used is an N-aliphatic hydrocarbyl alkylene diamine, the aliphatic hydrocarbyl group will have 8 to 24 carbon atoms and will preferably be alkyl and the alkylene group will have 2 to 6 carbon atoms. The preferred N-aliphatic hydrocarbyl alkylene diamine is N-aliphatic hydrocarbyl 1,3-propylenediamine which are commercially available. A preferred commercially available polymeric polyamine is believed to be the polymeric reaction product of N-tallow-1,3-propylenediamine with epichlorohydrin sold as "Polyflo 130" sold by Universal Oil Co. The polymeric polyamine reaction product will have a degree of polymerization of about 2 to 20. The description of these materials is also disclosed in U.S. Pat. No. 3,917,466.

Preferably, the polymeric polyamine reaction product component will be used in the form of a sulfonic acid salt. Useful are oil soluble sulfonic acids such as an alkane sulfonic acid or an aryl sulfonic acid. Particularly suitable is dodecyl benzene sulfonic acid.

The hydrocarbon soluble copolymer of an alkylvinyl monomer and a cationic vinyl monomer is described in and may be made by the procedures of U.S. Pat. No. 5,672,183, the entirety of which is incorporated by reference herein. In a preferred embodiment, the copolymer has an alkylvinyl monomer unit to cationic vinyl monomer unit ratio of from 1:1 to about 10:1, the copolymer having a number average molecular weight of from about 800 to about 1,000,000. In another embodiment, the cationic vinyl monomer is a cationic quaternary ammonium vinyl monomer, and in a preferred embodiment is a cationic quaternary ammonium acrylate monomer or a cationic quaternary ammonium methacrylate monomer. In another embodiment, the cationic vinyl monomer corresponds to the formula:

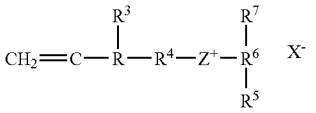

wherein Z is selected from the group consisting of nitrogen, phosphorus and sulfur, X is a nonhalogen atom, R is selected from the group consisting of —C(=O)O—, —C(=O)NH—, straight chain and branched alkylene groups, divalent aromatic groups and divalent alicyclic groups, $R^3$ is selected from the group consisting of hydrogen and methyl, $R^4$ is a straight chain or branched alkylene of up to about twenty carbon atoms ($C_1$-$C_{20}$), and $R^5$, $R^6$ and $R^7$ are independently each a straight chain or branched alkyl of up to about twenty carbon atoms, provided however that if Z is sulfur $R^7$ is absent. Optionally, a copolymer of an alkyl vinyl monomer and a nitrile-containing monomer may be used in conjunction with the copolymer of alkylvinyl monomer and cationic vinyl monomer.

The components of the conductivity-improving additive according to the invention are present in the fuel oil composition in an amount effective to improve conductivity.

The polyacrylate, polymethacrylate or polyfumarate materials are preferably used in the compositions of the present invention in amounts ranging from 5-400 ppm, more preferably about 10-160 ppm (by weight).

The polysulfonic-polyamine mixture conductivity improver or the alkylvinyl monomer-cationic vinyl monomer copolymer conductivity improver may each be used in amounts from 0.25-2 ppm, preferably about 0.35-1 ppm.

The compositions of this invention may also contain an antioxidant compound. The amount of antioxidant compound incorporated may vary over a range of about 1-100 ppm, preferably about 10-50 ppm, such as about 25 ppm by weight.

Preferably, the antioxidant compound is a phenolic antioxidant compound.

The preferred phenolic antioxidant compounds are the hindered phenolics which are those which contain a sterically hindered hydroxyl group. These include those derivatives of dihydroxy aryl compounds in which the hydroxyl groups are in the ortho- or para-position to each other. Typical phenolic antioxidants include the hindered phenols substituted with alkyl groups of a total of 6 or more carbon atoms and the alkylene coupled derivatives of these hindered phenols. Examples of phenolic materials of this type are 2,6-di-t-butyl-4-methyl phenol (BHT, butylated hydroxy toluene); 2-t-butyl-4-heptyl phenol; 2-t-butyl-4-octyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-di-t-butyl-4-heptyl phenol; and 2-methyl-6-di-t-butyl-4-dodecyl phenol. Examples of ortho coupled phenols include 2,2'-bis(6-t-butyl-4-heptyl phenol); 2,2'-bis(6-t-butyl-4-octyl phenol); and 2,2'-bis(6-t-butyl-4-dodecyl phenol). Sulfur containing phenols can also be used. The sulfur can be present as either aromatic or aliphatic sulfur within the phenolic antioxidant molecule. BHT is especially preferred, as are 2,6- and 2,4-di-t-butylphenol and 2,4,5- and 2,4,6-triisopropylphenol, especially for use in jet fuels.

The compositions will preferably contain about 0.1-50 ppm of a metal deactivator, preferably 1-10 ppm by weight. Examples of suitable metal deactivators are:

(a) Benzotriazoles and derivatives thereof, for example, 4- or 5-alkylbenzotriazoles (e.g. tolutriazole) and derivatives thereof; 4,5,6,7-tetrahydrobenzotriazole and 5,5'-methylenebisbenzotriazole; Mannich bases of benzotriazole or tolutriazole, e.g. 1-[bis(2-ethylhexyl) aminomethyl]tolutriazole and 1-[bis(2-ethylhexyl) aminomethyl]benzotriazole; and alkoxyalkylbenzotriazoles such as 1-(nonyloxymethyl)-benzotriazole, 1-(1-butoxyethyl)benzotriazole and 1-(1-cyclohexyloxybutyl)-tolutriazole;

(b) 1,2,4-triazoles and derivatives thereof, for example, 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxytheyl)-1,2,4-trizole; and acylated 3-amino-1,2,4-triazoles;

(c) Imidazole derivatives, for example 4,4'-methylenebis (2-undecyl-5-methylimidazole) and bis[(N-methyl)imidazol-2-yl]carbinol octyl ether;

(d) Sulfur-containing heterocyclic compounds, for example 2-mercaptobenzothiazole, 2,5-dimercapto-1,3,4-thiadiazole and derivatives thereof; and 3,5-bis[di(2-ethyl-hexyl)aminomethyl]-1,3,4-thiadiazolin-2-one; and (e) Amino compounds and imino compounds, such as N,N'-disalicylidene propylene diamine, which is preferred, salicylaminoguanadine and salts thereof.

The fuel oil compositions of this invention may also contain one or more other additives commonly employed in fuels present in such amounts so as to provide their normal attendant functions. Examples are cold flow improvers such as ethylene-unsaturated ester copolymers, comb polymers containing hydrocarbyl groups pendant from a polymer backbone, polar nitrogen compounds, compounds having a cyclic ring system having at least two substituents of the formula $-A-NR^{15}R^{16}$ where A is linear or branched hydrocarbylene and $R^{15}$ and $R^{16}$ are $C_9$-$C_{40}$ hydrocarbyl, hydrocarbon polymers such as ethylene alpha-olefin copolymers, polyoxyethylene esters, ethers and ester/ether mixtures such as behenic diesters of polyethylene glycol. Other additives include lubricity additives such as fatty acids, dimers of fatty acids, esters of fatty acids, corrosion inhibitors, anti-icing additives such as ethylene glycol monomethyl ether or diethylene glycol monomethyl ether, biocides, thermal stability additives, anti-rust agents, anti-foam agents, demulsifiers, detergents, dispersants, cetane improvers, stabilisers, antioxidants, static dissipator additives and the like.

The fuel oil may be a hydrocarbon fuel such as a petroleum-based fuel oil for example gasoline, kerosene or distillate fuel oil. The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil or diesel fuel may be a straight atmospheric distillate, or it may contain minor amounts, e.g. up to 35 wt. %, of vacuum gas oil or cracked gas oils or of both.

Heating oils may be made of a blend of virgin distillate, e.g. gas oil, naphtha, etc. and cracked distillates, e.g. catalytic cycle stock. A representative specification for a diesel fuel includes a minimum flash point of 38° C. and a 90% distillation point between 282 and 380° C. (see ASTM Designations D-396 and D-975).

The fuel oil may have a sulphur concentration of 0.2% by weight or less based on the weight of the fuel. Preferably, the sulphur concentration is 0.05% by weight or less, such as 0.035% by weight or less or 0.01% by weight or less. The art describes methods for reducing the sulphur concentration of hydrocarbon middle distillate fuels, such methods including solvent extraction, sulfuric acid treatment, and hydrodesulphurisation. The additive of the invention is advantageous in the fuels having low sulphur contents, providing lubricity improvement and detergency.

Also, the fuel oil may be a biofuel, i.e. come from an animal or vegetable source, for example a vegetable or animal oil or both or derivatives thereof, or a mineral oil as described above in combination with biofuel.

Vegetable oils are mainly triglycerides of monocarboxylic acids, e.g. acids containing 10-25 carbon atoms and listed below

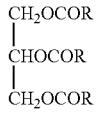

where R is an aliphatic radical of 10-25 carbon atoms which may be saturated or unsaturated.

Generally, such oils contain glycerides of a number of acids, the number and kind varying with the source vegetable of the oil.

Examples of oils are rapeseed oil, tall oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification. The preferred alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt. % from unsaturated fatty acids with 18 carbon atoms, are preferred.

The invention is particularly useful for the formulation of turbine combustion fuel oils which are generally those hydrocarbon fuels having boiling ranges within the limits of about 150° to 600° F. and are designated by such terms as JP-4, JP-5, JP-7, JP-8, Jet A, Jet A-1. JP-4 and JP-5 are fuels defined by U.S. military specification MIL-T-5624-N and JP-8 is defined by U.S. Military Specification MIL-T83133-D. Jet A, Jet A-1 and Jet B are defined by ASTM specification D1655.

EXAMPLES

The fuels described below were tested.

| | Fuel | | |
|---|---|---|---|
| | A | B | C |
| Type | Diesel | Diesel | Jet fuel |
| Density @ 15° C. | | 0.835 | 0.81 |
| Distillation ° C. | | | |
| I.B.Pt | 188.8 | 216.6 | |
| 10% @ | | 240.7 | 192 |
| F.B.Pt | 291.1 | 358.1 | 260 |
| Acidity mg KOH/gm | | | 0.007 |
| Aromatics % v/v | | 28.2 | 17 |
| Doctor test | | | Negative |
| Freeze Point ° C. | | | <−47 |
| Viscosity cS @ −20° C. | | | 5.1 |
| Viscosity cS @ 40° C. | 2.004 | 3.148 | |
| Copper corrosion | | | 1 |
| Hydrogen content % w/w | | | 13.9 |
| Total Sulphur % w/w | <0.01 | 0.0036 | <0.01 |
| Naphthalenes % v/v | | | 2.3 |
| Existent gum mg/100 ml | | | 1 |
| W.I.S.M. | | | 95 |
| J.F.T.O.T @ 260° C. | | | |
| Tube visual rating | | | 1 |
| Pressure drop mm Hg | | | 0 |
| Specific energy MJ/Kg | | | 42.9 |
| Smoke point mm | | | 25 |
| Abel Flash ° C. | | | 64 |
| Silver Corrosion | | | 1 |
| Cloud point | −36 | −40 | |
| Cetane number | 56.2 | 53.8 | |

Product Key:

| Code | Description |
|---|---|
| PMA-1 | Mn ~25,000 polymer (vs. polystyrene) of methacrylates of C8-C14 alcohols copolymerized with a methacrylamide of 3-(N,N-dimethylamino)propylamine. PMA is used in all examples as a 41.6% active ingredient solution in mineral oil, 200 ppm solution added. |
| Stadis 450 | 66% toluene, 13.3% 1-decene polysulfone, 13.3% polyamine (a reaction product of N-tallow-1,3-propylenediamine and epichlorohydrin) and 7.4% dodecylbenzene sulfonic acid. |
| T3514 | a commercial hydrocarbon soluble copolymer of an alkylvinyl monomer and a cationic vinyl monomer sold as "T3514" by Baker Petrolite as a conductivity improver. |

Fuel Conductivity

The effect of PMA on fuel conductivity of Fuel A in the presence and absence of the static dissipator additive "Stadis 450" was measured using an EMCEE 1152 conductivity meter.

Results:

Test temperature, 22° C.

| Additive | Treat Rate, ppm | Conductivity, pS/m |
|---|---|---|
| Base Fuel A | 0 | 1 |
| Stadis 450 | 0.5 | 43 |
| PMA-1 | 83.2 | 14 |
| Stadis 450 + PMA-1 | 0.5 + 83.2 | 280 |

The conductivity value of 280 greatly exceeds what would be predicted from the values observed when each additive was measured alone.

Fuels B and C were similarly tested with Stadis 450 and T3514. No synergistic effect was noted for Fuel B which has an inherent conductivity of 16 pS/m.

| Additive | Treat Rate ppm | Fuel B Conductivity (pS/m) | Fuel C Conductivity (pS/m) |
|---|---|---|---|
| Base Fuel | 0 | 16 | 2.3 |
| Stadis 450 | 0.25 | 31.7 | 65.7 |
| T3514 | 0.25 | 57 | 61.7 |
| PMA-1 | 50 | 60.3 | 20.3 |
| PMA-1 + Stadis 450 | 50 + 0.25 | 86 | 266 |
| PMA-1 + T3514 | 50 + 0.25 | 87 | 115.5 |

The invention claimed is:

1. A fuel oil composition which comprises a fuel oil having an inherent conductivity of less than 10 pS/m and an additive comprising:

(a) a polymethacrylate, polyacrylate or polyfumarate polymer (i) containing an amino or amido group from a copolymerized monomer or (ii) obtained through a transesterification or amidation reaction of the polymer with an aminoalcohol or amine but not prepared from a quaternary ammonium monomer having a number average molecular weight of 1,000 to 10,000,000; and (b) a conductivity improver comprising (i) an olefin polysulfone and (ii) a polymeric polyamine reaction product of epichlorohydrin and an aliphatic primary monoamine or an N-aliphatic hydrocarbyl alkylene diamine, or the sulfonic acid salt of the polymeric polyamine reaction product, or (c) a conductivity improver comprising a hydrocarbon soluble copolymer of an alkylvinyl monomer and a cationic vinyl monomer, wherein the copolymer has an alkylvinyl monomer unit to cationic vinyl monomer unit ratio of from 1:1 to 10:1, the copolymer having a number average molecular weight of from 800 to 1,000,000.

2. The composition of claim 1 wherein the polyacrylate, polymethacrylate or polyfumarate polymer contains an amino or amido group from a copolymerized monomer or is obtained through a transesterification or amidation reaction of the polymer with an aminoalcohol or amine, respectively.

3. The composition of claim 1 further comprising an antioxidant.

4. The composition of claim 1 further comprising a metal deactivator.

5. The composition of claim 1 wherein the polymer as defined in paragraph (a) of claim 1 has a molecular weight of about 5,000 to 1,000,000.

6. The composition of claim 1 wherein the fuel oil is a jet fuel.

7. The composition of claim 1 wherein the fuel oil is a diesel fuel or a heating oil.

8. An additive comprising the combination of:

(a) a polymethacrylate, polyacrylate or polyfumarate polymer (i) containing an amino or amido group from a copolymerized monomer or (ii) obtained through a transesterification or amidation reaction of the polymer with an aminoalcohol or amine but not prepared from a quaternary ammonium monomer having a number average molecular weight of about 1,000 to 10,000,000; and (b) a conductivity improver comprising (i) an olefin polysulfone and (ii) a polymeric polyamine reaction product of epichlorohydrin and an aliphatic primary monoamine or an N-aliphatic hydrocarbyl alkylene diamine, or the sulfonic acid salt of the polymeric polyamine reaction product, or (c) a conductivity improver comprising a hydrocarbon soluble copolymer of an alkylvinyl monomer and a cationic vinyl monomer, wherein the copolymer has an alkylvinyl monomer unit to cationic vinyl monomer unit ratio of from about 1:1 to about 10:1, the copolymer having a number average molecular weight of from about 800 to about 1,000,000.

9. A method of improving the conductivity of a fuel oil comprising incorporating an additive comprising:

(a) a polymethacrylate, polyacrylate or polyfumarate polymer (i) containing an amino or amido group from a copolymerized monomer or (ii) obtained through a transesterification or amidation reaction of the polymer with an aminoalcohol or amine but not prepared from a quaternary ammonium monomer having a number average molecular weight of 1,000 to 10,000,000; and (b) a conductivity improver comprising (i) an olefin polysulfone and (ii) a polymeric polyamine reaction product of epichlorohydrin and an aliphatic primary monoamine or an N-aliphatic hydrocarbyl alkylene diamine, or the sulfonic acid salt of the polymeric polyamine reaction product, or (c) a conductivity improver comprising a hydrocarbon soluble copolymer of an alkylvinyl monomer and a cationic vinyl monomer, wherein the copolymer has an alkylvinyl monomer unit to cationic vinyl monomer unit ratio of from 1:1 to 10:1, the copolymer having a number average molecular weight of from 800 to 1 ,000,000, into a fuel oil composition having an inherent conductivity of less than 10pS/in.

* * * * *

UNITED STATES PATENT AND TRADEMARK OFFICE

CERTIFICATE OF CORRECTION

PATENT NO. : 7,520,906 B2
APPLICATION NO. : 10/882120
DATED : April 21, 2009
INVENTOR(S) : Fiona K. Gormley It is certified that error appears in the above-identified patent and that said Letters Patent is hereby corrected as shown below:

Col. 8, claim 9, last line, delete "10pS/in" and insert --10 pS/m--.

Signed and Sealed this

Twenty-sixth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,520,906 B2
APPLICATION NO. : 10/882120
DATED : April 21, 2009
INVENTOR(S) : Fiona K. Gormley It is certified that error appears in the above-identified patent and that said Letters Patent is hereby corrected as shown below:

Col. 8, claim 9, line 60, delete "10pS/in" and insert --10 pS/m--.

This certificate supersedes the Certificate of Correction issued May 26, 2009.

Signed and Sealed this

Sixteenth Day of June, 2009

John Doll

JOHN DOLL
*Acting Director of the United States Patent and Trademark Office*